United States Patent [19]

Scholz

[11] 3,968,758

[45] July 13, 1976

[54] ARRANGEMENT FOR THE TUFTING OF CARPETS

[76] Inventor: Hartmut Scholz, No. 10 Wolfsteiner Strasse, D-8501 Allersberg, Germany

[22] Filed: Nov. 1, 1974

[21] Appl. No.: 520,119

[30] Foreign Application Priority Data

Nov. 13, 1973 Germany ..... 2356585

[52] U.S. Cl. ..... 112/80; 112/252

[51] Int. Cl.[2] ..... D05C 15/06

[58] Field of Search ..... 112/79,5, 79 R, 79 FF, 112/80, 252, 78

[56] References Cited

UNITED STATES PATENTS

| | | | |
|---|---|---|---|
| 3,142,276 | 7/1964 | Schauer | 112/80 |
| 3,144,844 | 8/1964 | Elliott et al. | 112/80 |
| 3,225,723 | 12/1965 | Wilkes | 112/80 |
| 3,389,667 | 6/1968 | Mueller | 112/79.5 |
| 3,430,590 | 3/1969 | Looper | 112/80 |

*Primary Examiner*—H. Hampton Hunter

*Attorney, Agent, or Firm*—Haseltine, Lake & Waters

[57] ABSTRACT

An arrangement for the tufting of rugs or carpets during needleworking by means of a hollow needle penetrating into the backing fabric, and through which the thread is conveyed in an air stream. The arrangement provides in that the air inlet aperture in the needle, in the direction of movement of the thread, is located behind or upstream of the thread infeed, as well as providing a cutter severing the thread in time, and including a common synchronously operating drive for the cutter actuation and the needle lifting.

11 Claims, 7 Drawing Figures

Fig.3
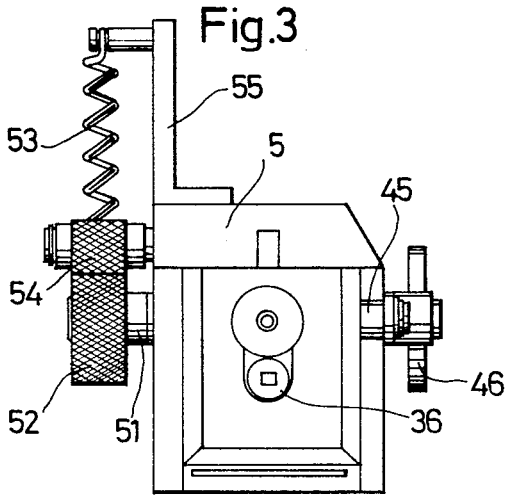
Fig.4
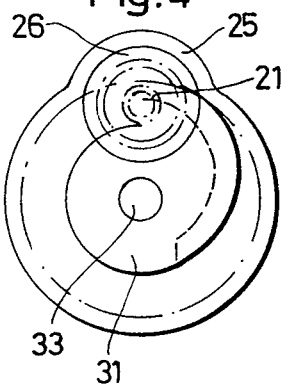
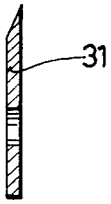
Fig. 5
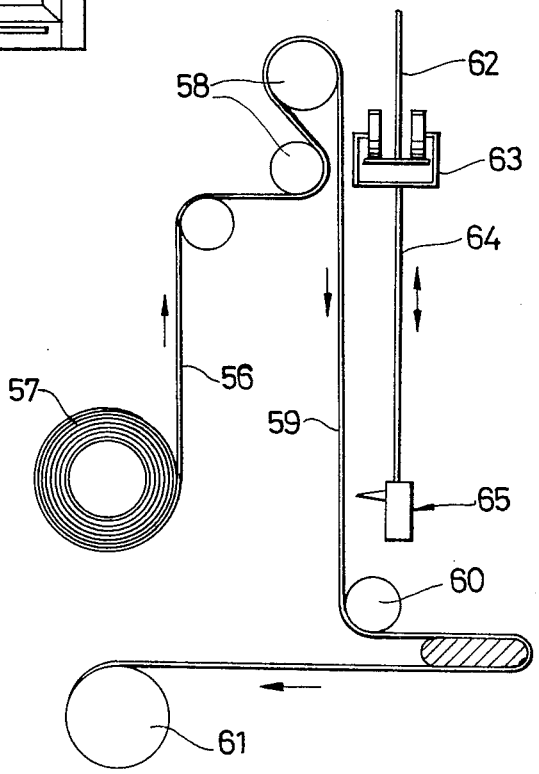
Fig. 7

ARRANGEMENT FOR THE TUFTING OF CARPETS

FIELD OF THE INVENTION

The present invention relates to an arrangement for the tufting of rugs or carpets during needleworking by means of a hollow needle penetrating into the backing fabric, and through which the thread is conveyed in an air steam.

DISCUSSION OF THE PRIOR ART

In the presently employed technology, the needle penetration is carried out mechanically, since for the actual forward movement of the needle there are known a mechanical drive, as well as a pneumatic pressure. In all instances, a loop is formed so that the finished goods must be sheared in a subsequent specialized operation, if a velour is to be produced. Another known measure employed for the tufting of velours consists of in that it is made from two sides, and namely, that the needling is carried from one side, whereas from the other side there are cut open the thus formed loops. This requires the use of expensive machines which, in addition, due to the two-sided operation, cannot work at an unrestricted width. Finally, these machines can be set for only one pattern, which repeats itself after a predetermined period.

SUMMARY OF THE INVENTION

Accordingly, predicated on the state of the technology, the present invention has as an object to provide an arrangement for the tufting of carpets which is simple to operate and which, due to its construction, is not restricted in either working width nor in the particular pattern in which it is to operate and which, finally, requires the lowest possible expenditures and through its uncomplicated construction affords a higher degree of operative safety.

Inventively, the foregoing object is achieved in that the air inlet aperture in the needle, in the direction of movement of the thread, is located behind or upstream of the thread infeed, as well as providing a cutter severing the thread in time, and including a common synchronously operating drive for the cutter actuation and the needle lifting.

The inventive measure thus leads to the advantage that the thread is no longer pushed through the needle passageway as with the usual application of pressurized air, but may be practically pulled through the needle in conformance with an injector effect. This facilitates a considerably improved and more uniform thread conveyance during stitching. In addition thereto, there is inventively achieved a new operative sequence to an extent in that, namely, the thread is cut already in the tufting arrangement into the particular desired length. There are also not formed a plurality of loops which must be first cut open or removed through shears, but already during the operation of the needle there is formed a velour goods, so as to eliminate the need for an additional operation. The unity of the drive for the rotating cutter and the to-and-fro moving needle renders superfluous any additional measures for coordination of the two movements.

It is, however, of particular advantage that the inventive tufting arrangement need be merely located on one side of the backing fabric, which has the result that the goods may be practically unrestricted in width. On the other hand, in this manner there is formed an extremely simply manipulated comparatively small portable apparatus. Finally, by means of this apparatus there may be produced any desired and also irregular patterns, which is preferably desired for individual pieces, for the production of which the inventive arrangement comes primarily into consideration.

It also lies within the scope of the invention that the needle is supported on a to-and-fro or reversely movable piston, in which there are connected to the sides thereof an infeed conduit for the thread, as well as an air passage upstream thereof, and that the piston is connected with a bearing block for the driven cutter. The inlet aperture for the air suitable is positioned so far ahead of the thread infeed, whereby the air stream exerts an undisturbed pulling effect on suitably thread, so that the thread is practically fully extended. This is, however, the precondition for the production of thread sections of uniformly remaining lengths. For this purpose, the suitably rotating cutter takes a full part with the piston and, respectively, the needle movement.

The piston, according to a further feature of the invention, includes a carrier tang or projection which is connected with a crankshaft drive through the intermediary of a pusher rod. It lies within the scope of this concept to employ a rotating cutter, and support this on its drive shaft so as to be secured against rotation but being longitudinally movable relative thereto. This arrangement forms a particularly simple and uncomplicated drive transmission to the knife and, namely, in coordination with the to-and-fro moving needle motion.

Furthermore, it also lies within the scope of the invention to axially divide the needle, and to support the forward portion thereof which receives the needle point, ahead of the air inlet aperture and the thread infeed, in a swivel head which is pivotable about the needle axis. For this purpose, in accordance with another feature of the invention, the forward needle portion is supported in said swivel head, which is located at the side of a housing, so as to rotationally be fixed and axially movable relative thereto and, as occasioned, the swivel head includes a hand lever so that, in accordance with need, it may be pivoted more or less extensively about the needle axis. This construction of the inventive arrangement thereby affords the advantage that the operating orientation may be varied alone through a pivoting of the needle, which is of particular significance in the tufting of patterns.

In a further embodiment of the invention, supported in a recess in the piston there is supported a pressure ring which, under the effect of spring pressure, lies against the rotating cutter disc to form a counter cutter. This will facilitate an undisturbed cut which is a precondition for a uniform velour height of the finished goods.

It is also within in the scope of the invention to branch off a further drive for a thread transporter from the common drive. This transporter may, for example, consist of a pair of friction rollers which are supported along the side of the housing in which convey the thread through the hollow needle at a feed velocity determined by the air stream. Inventively, the needle passageway may be constructed with an oval cross-section.

Finally, the invention contemplates that the arrangement for the tufting of carpets by means of a hanger installation is suspended opposite to an approximately vertically disposed fabric conveyance, so as to be movable sideways, as well as up and down. This measure facilitates the operation on particularly large and, above all, wide individual pieces, as well as for an individual and complicated pattern, and upon occasion even for repairs.

BRIEF DESCRIPTION OF THE DRAWINGS

Further features, details and advantages of the invention may be ascertained from the following description of a preferred embodiment thereof, taken in conjunction with the accompanying drawings; in which:

FIG. 3 is a section taken along line III—III in FIG. 2;

FIG. 4 is a section taken along line IV—IV in FIG. 1;

FIG. 5 is an enlarged axial section through the cutter disc;

FIG. 7 is a schematic illustration of an application of the inventive arrangement.

DETAILED DESCRIPTION

Figures 1, 6:
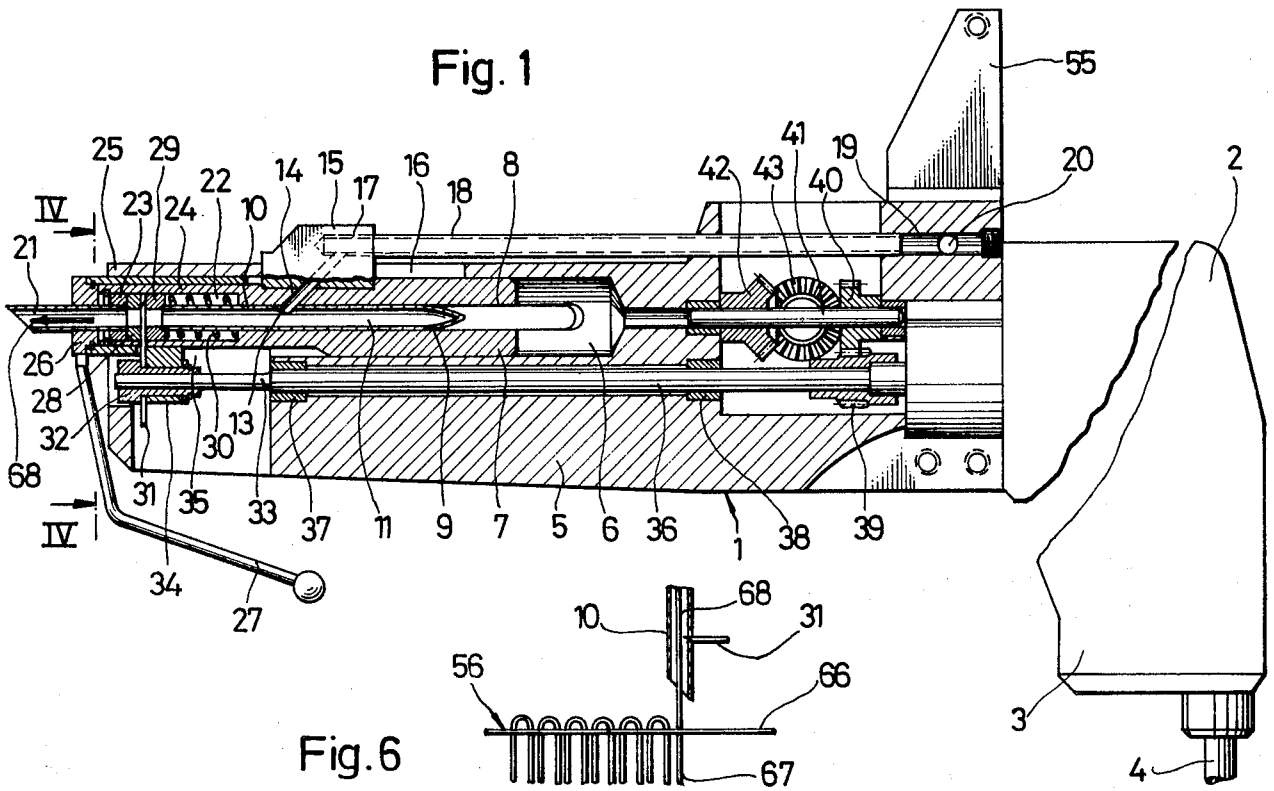
FIG. 1 illustrates, partly in section, a side view of a tufting arrangement according to the invention, shown with the needle in the extended position.
FIG. 6 is a detail illustrative of the operation of the arrangement.
Figure 2:
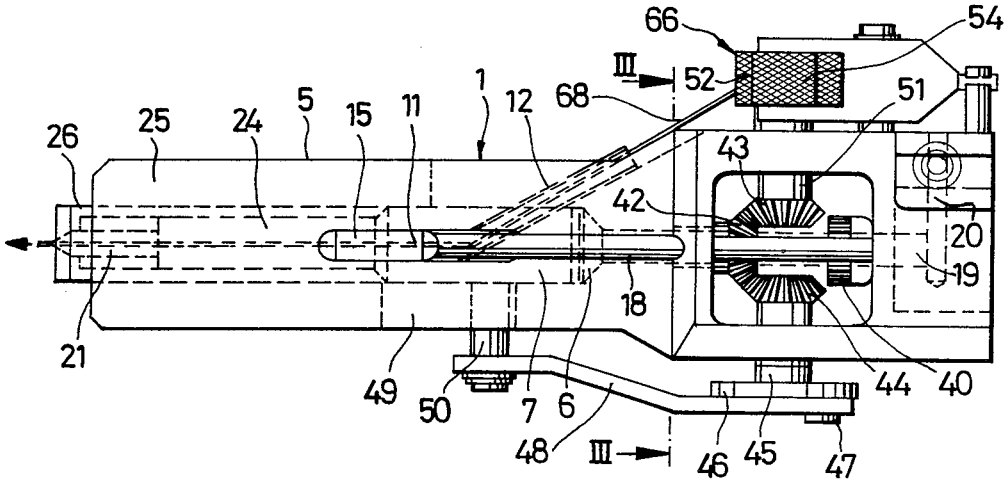
FIG. 2 is a plan view of the arrangement of FIG. 1 with the needle shown in the recessed position.

Referring now in detail to FIG. 1 of the drawings, a housing 1 has a head 2 which contains a drive (not shown in detail). Connected to a gripping member 3 of the housing is an electrical current supply cable 4.

In the forward portion 5 of the housing there is provided a forwardly opening bore 6, within which there is located a piston 7, the latter of which includes an inner bore 8, and having fastened therein the rear portion 9 of a hollow needle 10. Located at the inner end of the needle 10, and located at an angle to the longitudinal axis of the needle passageway 11, there is positioned a conduit support 12 forming a thread infeed, which projects outwardly through an aperture in the housing forward portion 5. Ahead of this thread infeed, the needle 10 is provided with an air inlet aperture 13 which is connected to an air passageway 14 and which terminates in a nozzle head 15 fixedly connected with the piston 7. The nozzle head extends through an aperture 16 formed in the housing forward portion 5.

An air passageway 18 is connected to a bore 17 in the nozzle head 15, which longitudinally displaceably extends into a housing bore 19, the latter of which connects with a pressurized air connector 20.

The forward portion 21 of the needle 10 is rotatably supported in a closure member 23 located in a forward recess 22 of piston 7, or together with this closure member 23 is rotatably supported in a piston sleeve 24. The piston sleeve 24 projects into a swivel head 26 which is rotatably but axially fixedly supported in a housing nose portion 25, and which has a handlever 27 fastened thereto. Within the head 26 of the forward portion 21 of needle 10 is supported so as to be longitudinally movable but fixed against rotation, whereby, in response to pivoting of the handlever 27, the forward portion 21 of the needle 10 is also pivotable about its axis.

At the inner side of the closure 23 there is supported an intermediate ring 28, and in close spacing therefrom, a pressure ring 29 which is subjected to the effect of a pressure spring 30 supported in the recess 22. A cutter disc 31 projects into the gap between the intermediate ring 28 and the pressure ring 29 (compare also FIGS. 4 and 5), which is seated on a sleeve 32, the latter of which is fastened to the end of a drive shaft 33 and supported in a bearing block 34. The latter is rigidly connected with the sleeve 24 of piston 7, and extends through an aperture 35 in the housing forward portion 5. The drive shaft 33 and sleeve 32 are at least connected so as to be secured against mutual rotation whereas, on the other hand, either the sleeve on the drive shaft 33 is longitudinally displaceably supported, or the drive shaft 33 engages telescopically in the shaft 36 under rotationally restrictive and concurrently longitudinally displaceable connection, whereby the shaft 36 is supported in the two bearings 37 and 38 in the housing forward portion 5 and is in an operative connection with a drive motor (not shown). The piston 7 which receives the rear end of the needle 10 in order to also displace the needle in an axial direction during its own axial movement, is provided with the intermediate ring 28 and pressure ring 29 at its forward end. The rings are axially fixed in the recess of piston 7, but are rotatable about the axis of the latter. The cutter disc 31 is located in the space between the two rings 28 and 29, and is fixedly mounted on the shaft 33. Fastened onto the rear end of this shaft is a spur gear 39, which engages with another spur gear 40 mounted on a short intermediate shaft 41. The latter supports a bevel gear 42 which, in turn, is in operative engagement with two coaxial mutually oppositely located bevel gears 43 and 44.

By means of bevel gear 44 there is branched off the drive of the to-and-fro moving motion of the piston 7, and namely the shaft 45 which carries bevel gear 44 extends through the housing forward portion 5, and at its outer end supports an eccentric disc 46 with the eccentric 47. The latter is contacted by a pusher rod 48, whose other end is linkably connected with a follower shaft 50 which extends through another aperture 49 formed in the housing forward portion 5, and which is fixedly connected with the piston 7.

The bevel gear 43 is mounted on a shaft 51 which is supported in the housing forward portion 5, and which carries a transport wheel 52 at its outer end, whose roughened surface is in frictional engagement with a similarly formed surface of a second transport wheel 54 under the effect of a spring 53. The other end of the spring 53 is located on the frame 55 which is fastened to the side of the housing.

The operation of the inventive arrangement may be ascertained from the schematic illustration of FIG. 7. The length 56 of the backing fabric or material is drawn off from a supply roller 57, and conveyed through the two transport rollers 58 along a somewhat vertical portion 59 downwardly to the reversing roller 60, and finally wound on the storage roller 61 provided for the finished goods. Opposite the vertically extending section of the backing fabric or material length 56 there is located an upper runway rail 62, here shown in a T-shaped construction, having supported thereon a carriage 63 which is axially movable by means of rollers, or the like. Suspended on the up-and-downwardly windable hanger 64 is the inventive arrangement 65 in a location opposite to the portion 59 of the backing fabric length, so that the tufting can be carried out at any desired location of this fabric length from the rear-side 66 thereof facing towards the arrangement 65 (see FIG. 6). Namely, as may be ascertained from FIG. 6, the open end 67 of the thread 68 which is conveyed through the hollow needle 10 is, upon the penetration of the needle into the backing fabric 56, conveyed through the latter and the hollow needle 10 is then withdrawn (compare position in FIG. 6). Subsequently, the arrangement together with the hollow needle is displaced sideways, and the needle 10 again re-introduced. In the interim, the cutter 31 has separated the thread end 67 from the thread 68 by means of a severing cut so that also this rear end may now be introduced through the hollow needle which penetrates into the backing fabric 56. This sequence is then continually repeated in the desired manner and patterning.

The mechanical operation of the inventive arrangement may be ascertained to be as follows:

Through the pressure air connector 20 and the air passages 14, 18, there is produced a continual air stream in the needle 10 which exists at the needle point. Since the air flows through only the forward portion of the needle 10, and the thread introduction takes place, however, only through conduit connector 12 located rearwardly in the direction of movement of the thread 68, there is practically produced an injector effect in the hollow needle 10, the latter of which has preferably an oval cross-section, by means of which the thread 68 is pulled through the hollow needle 10. Thereby, the thread transporter, which consists of the two transport rollers 52 and 54, provides for a continual introduction or infeed of the thread 68 from the supply roller (not shown). This thread transporter is driven by means of the bevel gear drive 42, 43 and the two spur gears 39, 40 in synchronism with the drive shaft 36 for the rotating cutter disc 31 which, for example, carries out a severing cut for each complete rotation.

The drive is transmitted to the eccentric disc 46 through the bevel gears 42, 44, in response to which the piston 7 is displaced within the housing forward portion 5 in a similar synchronously supported to-and-fro moving motion. The hollow needle 10, as well as the cutter 31 take part in this movement, wherein the latter extends into the needle passage only during its cutting. The cutter 31 thereby is taken along by the bearing block 34 which is connected with the piston 7.

Inasmuch as the piston 7 is movable back-and-forth in an axial direction and, consequently, also the rings 28 and 29, the cutter disc 31 must also effectuate these movements. For this purpose there is provided the sleeve 32 on the drive shaft 33 which eccentrically supports the cutter, and which is connected to the shaft so as to be fixed against rotation but axially slidable thereon. However, in lieu thereof it is also possible that the entire drive shaft is arranged so as to be telescopically slidable within the shaft 36.

The shaft 36 which is rotationally fixedly connected with drive shaft 33, and thereby with the cutter disc 31, is in a direct connection with a drive arrangement (not shown) for the inventive arrangement. Consequently, the spur gear 39 which interengages with spur gear 40 is arranged on the shaft 36, so as to effect through the intermediary of a plurality of the individually described planetary gears, wheels and gear wheels, as well as eccentric disc 46, pusher rod 48 and follower shaft 50, the back-and-forth movement of the piston 7. The gear ratios of the gear wheels are hereby so selected that the piston 7 carries out a complete back-and-forth movement when the cutter disc 31 is rotated once about its axis. The foregoing signifies that the severing of the thread with the aid of the cutter disc 31 is carried out in the rear reversing position of the piston 7, meaning in the furthermost inward displaced position of the latter. In effect, the cutter disc 31 will have its cutting axis just cross the axis of the needle, and thereby sever the thread, when the piston 7 has reached the inner reversing point of its stroke.

The forward portion 21 of the needle 10 inventively has an oval external cross-section. With this oval cross-section coincides the cross-section of the aperture in the swivel head 26 which receives the forward portion 21, so that the forward portion 21 of the needle 10, upon actuation of the swivel head 26 by means of the hand lever 27, may be readily displaced therewith. The inner cross-section of the needle 21, in opposition thereto, preferably circular. However, it may also be, in conformance with the external cross-section, similarly oval.

While there has been shown what is considered to be the preferred embodiment of the invention, it will be obvious that modifications may be made which come within the scope of the disclosure of the specification.

What is claimed is:

1. In an arrangement for the tufting of carpets during needleworking, including a hollow needle having an axial passageway and adapted to penetrate through the backing fabric of said carpet; a piston, means mounting said hollow needle for axial reciprocation within said piston; means for transporting the tufting thread through said needle in an airstream, said needle including an air inlet aperture for the sideways infeed of said air stream; a thread infeed aperture for the sideways infeed of said thread into said needle, said air inlet aperture being behind said thread infeed aperture in the direction of conveyance of said thread through said needle; a cutter for severing the thread in said needle passageway in timed sequence; and a common synchronously operating drive for effecting cutter movement and needle lifting motion, the improvement comprising; said air inlet aperture and said thread infeed aperture communicating with the interior of said hollow needle at separate locations, said hollow needle having the forward portion thereof located within said piston, and means mounting said needle so as to be rotatable about its longitudinal axis, said cutter being a rotatable cutter.

2. An arrangement as claimed in claim 1, comprising means for axially reciprocating said piston; an infeed conduit for said thread being provided at a side of said piston; an inlet passageway for said airstream in said side of said piston; and a bearing block for said cutter being connected to the side of said piston.

3. An arrangement as claimed in claim 2, comprising a follower shaft on said piston; a housing for said piston; a gear drive in said housing; and a pusher rod connecting said follower shaft with said gear drive.

4. An arrangement as claimed in claim 3, comprising a drive shaft for said cutter in said housing; and means supporting said cutter on said drive shaft so as to be rotatably fixed and axially movable relative thereto.

5. An arrangement as claimed in claim 1, said needle being longitudinally divided into forward and rear portions; and a swivel head supporting said forward needle portion and the needle point therein for pivotal motion about the needle axis.

6. An arrangement as claimed in claim 5, said needle forward portion being supported in said swivel head so as to be rotatably fixed and axially displaceable relative thereto.

7. An arrangement as claimed in claim 5, comprising a handlever for imparting movement to said swivel head.

8. An arrangement as claimed in claim 2, said piston including a cutout portion; a spring-loaded pressure ring in said cutout portion adapted to be biased into contact with said cutter for forming a counter cutter in conjunction therewith.

9. An arrangement as claimed in claim 1, comprising a thread transporter means; and an auxiliary drive branching from said common drive for driving said thread transporter means.

10. An arrangement as claimed in claim 1, said needle having a forward portion of generally oval external cross-section.

11. An arrangement as claimed in claim 1, comprising a hanger installation for suspending said arrangement for relative side and vertically reciprocating movement with respect to a generally vertically oriented carpet backing fabric.

* * * * *